United States Patent [19]

Shimizu

[11] Patent Number: 4,484,850

[45] Date of Patent: Nov. 27, 1984

[54] BOOKBINDING MACHINE

[76] Inventor: Masaaki Shimizu, c/o Horizon Co., Ltd., 510, Kuze Oyabu-cho, Minami-ku, Kyoto, Japan

[21] Appl. No.: 377,919

[22] Filed: May 13, 1982

[30] Foreign Application Priority Data

May 18, 1981 [JP] Japan ..... 56-72178

[51] Int. Cl.[3] ..... B42C 5/00; B42C 19/00

[52] U.S. Cl. ..... 412/11

[58] Field of Search ..... 412/4, 20, 27, 37, 11; 74/76, 128

[56] References Cited

U.S. PATENT DOCUMENTS

| | | | |
|---|---|---|---|
| 1,380,294 | 5/1921 | Gitzendanner | 412/11 |
| 1,389,769 | 9/1921 | Juengst | 412/27 |
| 1,867,803 | 7/1932 | Bredenberg | 412/27 |
| 3,739,412 | 6/1973 | Card et al. | 412/27 |
| 3,863,596 | 2/1975 | Anderson | 412/20 |
| 3,888,722 | 6/1975 | Blair et al. | 412/27 |
| 4,237,569 | 12/1980 | Muller | 412/27 |
| 4,244,069 | 1/1981 | Hale | 412/20 |

*Primary Examiner*—E. R. Kazenske

*Assistant Examiner*—Paul M. Heyrana, Sr.

*Attorney, Agent, or Firm*—Christensen, O'Connor, Johnson & Kindness

[57] ABSTRACT

A bookbinding machine which comprises a reference plate, an adhesive applicator, a cover applicator and a milling device. The adhesive applicator and the cover applicator are arranged on one side of the reference plate while the milling device is arranged on the opposite side thereof. A clamping device clamps a plurality of piled sheets of paper to be bound into a book standing on its edge surface or back on the reference plate. A selector is provided so as to selectively move the clamping device from above the reference plate in either of the two opposite directions. When the clamping device has been moved to the milling device, a controller causes the clamping device to return from the milling device to the reference plate, where the clamping device temporarily releases the book so as to adjust the level of the back of the book to that of the reference plate and clamps the book again to carry it to the adhesive applicator and then to the cover applicator and finally back to the reference plate.

6 Claims, 6 Drawing Figures

+
−
90
90a
90b
89
91
71
71a
71b
72
72a
72b
73
73a
73b
85
85a
85b
85c
86
86a
86b
86c
87
87a
88
88a
19

BOOKBINDING MACHINE

BACKGROUND OF THE INVENTION

This invention relates to a bookbinding machine.

There is known a bookbinding machine wherein adhesive is applied to one edge surface or back of a book comprising a plurality of piled sheets of paper to be bound together and a cover sheet is applied to the back of the book to which adhesive has been applied. There is also known a bookbinding machine wherein an adhesive applicator and a cover applicator are successively arranged in the path along which a clamper which clamps a plurality of piled sheets of paper to be bound into a book is reciprocated so that as the clamper is moved, the adhesive applicator applies adhesive to the back of the book, onto which a cover sheet is then applied by the cover sheet applicator.

In these types of bookbinding machines, it is sometimes required that before application of adhesive to the back of a book, the back of the book is cut and roughened and adhesive is applied to the cut and roughened surface of the back. It is customary to provide a milling device in addition to the adhesive applicator and the cover applicator so that the milling device can selectively be used as occasion demands.

In a conventional bookbinding machine, a clamper which clamps a boundle of sheets of paper to be bound into a book is moved from a reference plate for defining the level at which one edge or back surface of the book is supported, and in the path along which the clamper is moved there are arranged a device for milling the back of the book, an adhesive applicator and a cover applicator. A book comprising a plurality of piled sheets of paper to be bound is placed on the reference plate so as to stand on its one edge or back and is clamped by the clamper, which carries the book along the above-mentioned path. First the milling device cuts the back of the book, to which the adhesive applicator applies adhesive so as to bind the book at the back, and then the cover applicator applies a cover sheet to the adhesive back of the book. Then the clamper is moved in the opposite direction as far as above the reference plate, where the clamper releases the book, which is taken out of the machine.

If the milling device is not used for bookbinding, the device is moved out of the path of the clamper by lowering the device a sufficient distance, so that milling operation is omitted. In this case, it is necessary not only to remove the milling device but also to adjust the height of the plane at which the adhesive applicator applies adhesive to the back of the book and the height of the plane at which the cover applicator applies a cover sheet to the back of the book.

The reasons why the removal and adjustment are required are as follows: When the milling device has cut the back of a book, the level of the cut surface of the back of the book becomes higher than that of the reference plate by the thickness the back of the book has been cut away. Therefore, the level of the plane at which the adhesive applicator applies adhesive must be adjusted so as to enable contact with the cut surface of the back of the book. Also the level of the plane at which the cover applicator applies a cover to the back of the book must be adjusted so as to enable application of a cover sheet to the adhesive cut surface of the back of the book.

On the contrary, when the milling device is not used, adhesive is applied to the back of a book as set by the reference plate and a cover sheet is then attached to the adhesive back of the book. In this case, obviously the level at which the back of the book is positioned is lower than the level at which the back of the book would be positioned if it were milled as in the previously mentioned case. Therefore, if the milling device is not used, the level of the plane at which the adhesive applicator applies adhesive to the back of a book and the level of the plane at which the cover applicator applies a cover sheet to the back of the book to which adhesive has been applied must be adjusted so as to conform to the level of the back of the book that was set on the reference plate.

In the prior art arrangement that the milling device is selectively put into and out of use, it is necessary not only to selectively set the milling device in the bookbinding machine and remove it from the machine but also to adjust the positions of the adhesive applicator and the cover applicator. This certainly is very inconvenient.

Accordingly, the primary object of the invention is to provide a bookbinding machine wherein it is not necessary to adjust the levels of the adhesive applicator and the cover applicator regardless of whether the milling device is used or not.

Another object of the invention is to provide a bookbinding machine wherein it is not necessary to set the milling device in the machine or remove it therefrom regardless of whether the device is used or not.

The invention will be described in detail with reference to the accompanying drawings.

SUMMARY OF THE INVENTION

Briefly stated, the invention provides a bookbinding machine which comprises a reference plate, an adhesive applicator, a cover applicator and a milling device. The adhesive applicator and the cover applicator are arranged on one side of the reference plate while the milling device is arranged on the opposite side thereof.

A clamping device clamps a plurality of piled sheets of paper to be bound into a book (which will be referred to merely as a book hereinafter) set on the reference plate with its edge surface or back on the upper surface of the reference plate. A selector is provided so as to selectively move the clamping device from above the reference plate in either of the two opposite directions. When the clamping device has been moved to the milling device, a controller causes the clamping device to return from the milling device to the reference plate, where the clamping device releases the book so as to adjust the level or height of the back of the book to the level of the reference plate.

DESCRIPTION OF THE PREFERRED EMBODIMENT

Figure 1:
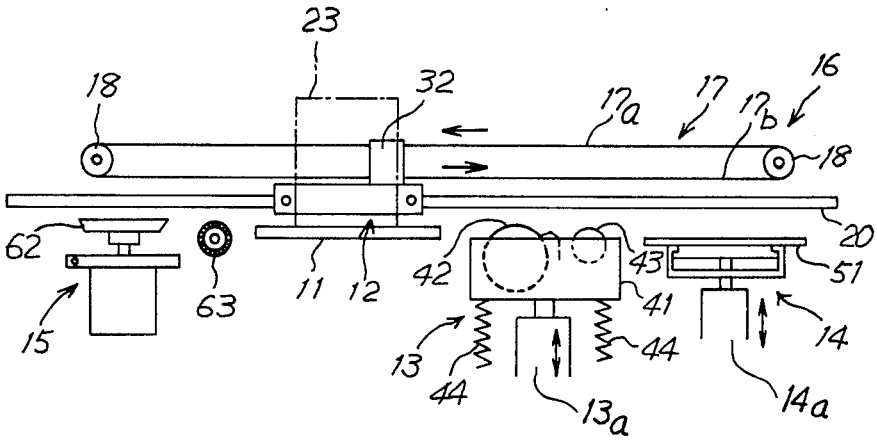
FIG. 1 is a schematic front view of one embodiment of the invention.
Figure 2:
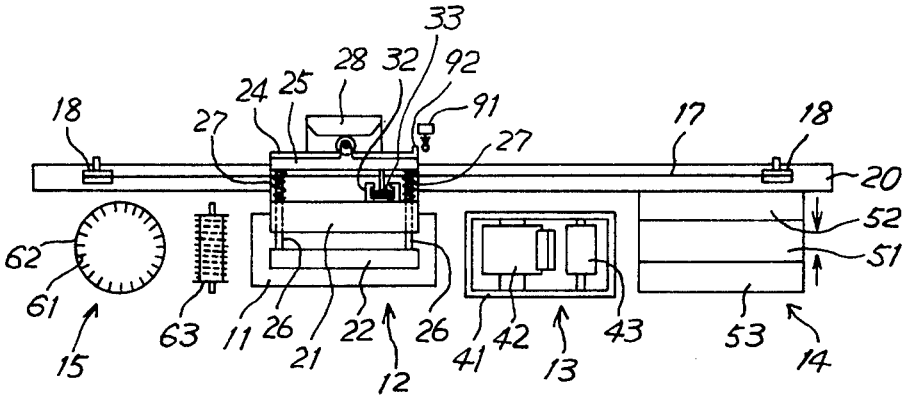
FIG. 2 is a top plan view of the machine shown in FIG. 1.

Referring to FIGS. 1 and 2, there is shown a reference plate 11 the upper surface of which defines the level of the back of a book. On one side (the right side in the figures) of the reference plate 11 an adhesive applicator 13 and a cover applicator 14 are arranged successively and on the opposite side (the left side in figures) of the reference plate 11 a milling device 15 is arranged. The level of the plane on which the milling device 15 mills the back of a book, the level of the plane on which the adhesive applicator 13 applies adhesive to the milled back of the book, and the level of the plane on which the cover applicator 14 applies a cover sheet to the adhesive back of the book are all set to the reference level of the reference plate 11.

Figure 6:
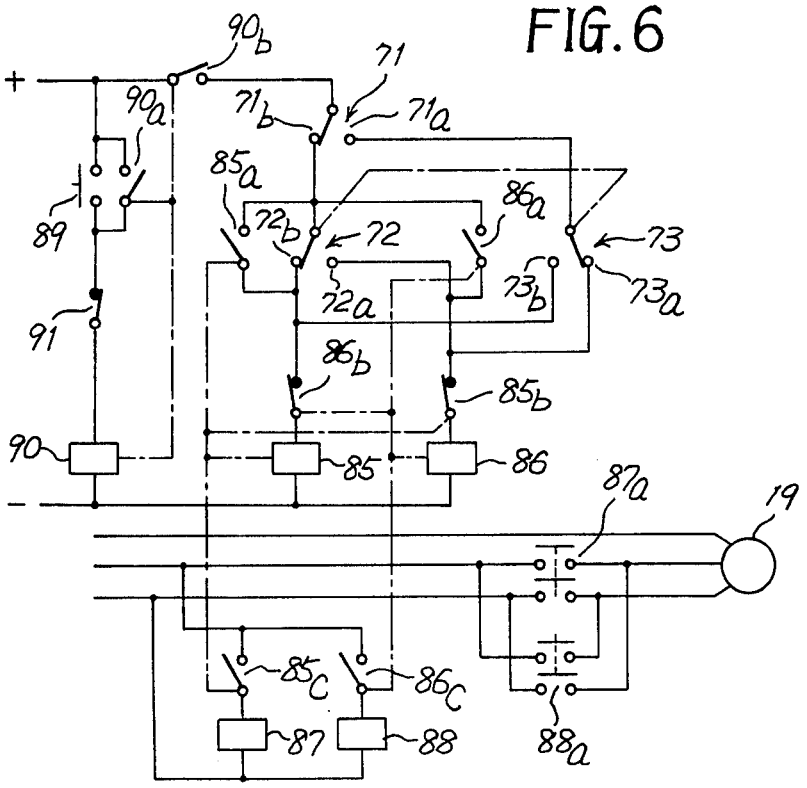
FIG. 6 is a diagram of an electrical control circuit of the machine of the invention.

A clamper 12 is reciprocated by a device 16 comprising an endless chain 17, a pair of sprocket wheels 18 and a reversible motor 19 (see FIG. 6).

The rotation of the motor 19 is so controlled as to cause reciprocal movement of the clamper 12 along a guide rail 20 as will be described in detail hereinbelow.

The clamper 12 comprises a fixed clamping member 21 and a movable clamping member 22, between which a book 23 is clamped. The fixed clamping member 21 is fixedly mounted on a carriage 24 movable along the guide rail 20. A slide 25 is slidable on the carriage 24 and is connected by a pair of rods 26 to the movable clamping member 22 so that the slide 25 and the clamping member 22 are movable together as will be described presently. A pair of compression springs 27 urge the slide 25 so as to move the movable clamping member 22 toward the fixed clamping member 21 thereby to clamp a book between the two clamping members 21 and 22.

When the clamper 12 has reached a predetermined position above the reference plate 11, a clamper-releasing dog 28 provided at a fixed position causes the slide 25 to be moved toward the fixed clamping device 21 against the force of the springs 27 so that the movable clamping member 22 is moved away from the fixed clamping member 21 thereby to release the book that has until then been clamped between the two clamping members.

The releasing operation is conducted when the bound book is to be taken out of the machine upon completion of the bookbinding. The releasing operation is also essential when the back of a book has been milled by the milling device 15.

As previously mentioned, when the milling device has initially milled the back of a book, the back of the book held by the clamper is raised to a higher level than it was before the milling operation. When the book is returned to the reference plate 11 after the milling operation, the dog 28 causes the clamper 12 to release the book, which drops onto the reference plane of the reference plate 11. This means that the level of the milled back of the book has now been adjusted to the reference level of the reference plane 11. Since the adjusted level of the back of the book is the same as the level of the adhesive application plane of the adhesive applicator and the level of the cover application plane of the cover applicator, it is not necessary to adjust the level of either of the two planes even when the back of the book has been cut.

Figure 3:
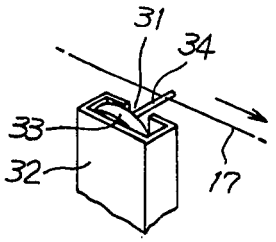
FIG. 3 is a perspective view of the connection between the clamper and the chain shown in FIGS. 1 and 2.

In order to move the clamper 12 by driving the chain 17, a pipe 32 having a vertical slot 31 formed in one lateral wall thereof as shown in FIG. 3 is fixed to the fixed clamping member 21. A roller 33 is enclosed in the pipe 32 so as to be vertically slidable therein and journalled on a shaft 34 which extends outwardly through the slot 31 so as to be fixed to the chain 17. As the chain 17 is driven, the driving force is transmitted to the clamper 12 through the shaft 34, the roller 33 and the pipe 32.

Suppose that the connecting point between the shaft 34 and the chain 17 is in the lower portion **17*b* of the chain in FIG. 1. As the chain 17 is driven from that position counterclockwise as shown by the arrows, the clamper 12 is moved to the right as far as the shaft 34 reaches the sprocket 18 at the right side, whereupon further movement of the chain 17 causes the connecting point between the shaft 34 and the chain to come around to the upper portion 17*a* of the chain, with the shaft 34 being moved upwardly in the pipe 32, and the clamper 12 is moved by the chain. At this time, however, although the chain 17 is driven in the same counterclockwise direction as before, the clamper 12 is moved in the direction opposite to the direction in which it was previously moved, since the upper portion 17*a* of the chain runs in the opposite direction to the running direction of the lower portion 17*b*** thereof.

Suppose, on the contrary, that initially the connecting point between the shaft 34 and the chain 17 is in the upper portion **17*a* thereof. In order to move the clamper to the right, the chain 17 is moved in the direction opposite to the direction of the arrows in FIG. 1. In either case, by driving the chain 17 in the same direction it is possible to reciprocate the clamper 12**.

The adhesive applicator 13 comprises a container 41 which contains a suitable adhesive of, e.g., a hot-melt type, and a drum 42 for application of adhesive arranged in the container. As a book carried by the clamper 12 passes over the drum 42 with the back thereof in contact with the drum, it is rotated so as to apply adhesive to the back of the book. Another drum 43 is provided to remove excess adhesive from the back of the book.

A pair of springs 44 urge the adhesive applicator 13 upwardly so that while the clamper 12 is moved to the right, the applicator is held in the path of movement of the clamper 12. In the return movement of the clamper 12 to the left, however, the applicator 13 is moved by a conventional motor arrangement, designated by the box **13*a* in FIG. 1**, against the force of the spring downwardly out of the path of the clamper thereby to avoid application of any adhesive to the book as it is moved to the left.

The cover applicator 14 has a top plate 51, upon which a cover sheet (not shown) is placed before the clamper 12 carrying a book reaches the applicator. When the clamper 12 has come to a position just above the top plate 51, the applicator 14 is pushed upwardly so as to press the cover sheet thereon onto the back of the book on which adhesive has been applied so that the cover sheet is adhered to the back of the book. The up and down movement of the cover applicator 14 is accomplished by a conventional motor device, designated by box **14*a* in FIG. 1**.

Figure 4:
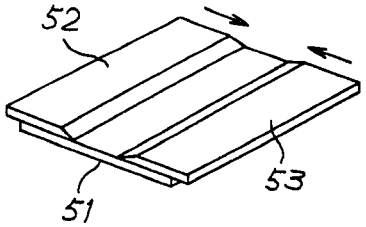
FIG. 4 is a perspective view of a portion of the cover applicator shown in FIGS. 1 and 2.

As shown in FIG. 4, the top plate 51 is provided on the upper surface thereof with a pair of slides 52 and 53 which are simultaneously movable in the opposite directions to each other. When the applicator 14 is raised in the above-mentioned manner, the slides 52 and 53 are moved toward each other as far as they press the cover sheet against the lateral side portions of the back of the book so that the cover sheet is bent around the opposite covers of the back of the book.

The milling device 15 includes a rotatable disk 62 provided on the upper surface thereof with a plurality of cutter blades 61, which cut the back of the book by a predetermined thickness leaving the cut surface of the back roughened or rugged. A rotary brush 63 is provided to brush the cut material or powder off the roughened surface of the back of the book.

When the chain 17 is driven so as to move the clamper 12 to the left, the clamper is caused at the left end of the path to return and move toward the right without changing the driving direction of the chain in the same way as when the clamper is moved to the right from the first.

When the clamper 12 is initially moved leftward, the milling device 15 cuts and roughens the back of the book. Upon completion of the leftward movement, the clamper 12 returns to the reference plate 11, where the clamper 12 does not stop but continues its rightward movement.

Regardless of whether the clamper 12 is moved to the right from the first or after the milling operation by the device 15, when the clamper 12 returns to the reference plate 11 after completion of the rightward movement, the clamper 12 is automatically stopped above the reference plate 11.

FIG. 6 shows an electrical circuit for controlling the above-mentioned movement of the clamper 12.

The direction of the initial movement of the clamper 12, that is, whether the clamper is initially moved toward the right or left is determined by a selector 71. When the selector 71 is changed over to a fixed contact 71*a*, the clamper 12 is initially moved toward the right. When the selector is changed over to the other contact 71*b*, the clamper is initially moved toward the left.

A pair of switches 72 and 73 are ganged together and their positions are reversed when the clamper 12 has returned to the start position above the reference plate 11. A mechanism for such reversal of the switch positions is shown by way of example in FIG. 5.

Between the upper and lower portions 17*a* and 17*b* of the chain 17 there is provided an operating plate 75 swingable about a pivot 74, with a spring 78 having its one end fixed to the plate 75 at 77 and its opposite end fixed to a fixed pin 76. The swingable plate 75 is formed with a regulating slot 79, into which a fixed pin 80 engages for regulation of the degree of swinging of the plate 75.

The operating plate 75 is also provided with a pair of rollers 81 and 82 which are selectively positioned in the path of the running chain 17 as will be described in detail later. A roller 83 is fixed to the chain 17.

The operating plate 75 is arranged at a predetermined position such that the rollers 81 and 82 are pushed by the roller 83 when the clamper 12 reaches a predetermined position above the reference plate 11. In the condition shown in FIG. 5 the roller 83 pushes the roller 82 so that the operating plate 75 has been rotated clockwise about the pivot 74 to the uppermost position. From the condition, the chain 17 advances so that the roller 83 approaches the plate 74 from the right side as shown by a broken circle or from the left side and pushes the roller 81 downward, whereupon the plate 75 is rotated counterclockwise against the force of the spring 78. When the straight line connecting the pins 76 and 77 passes the pivot 74, that is, when the plate 75 passes the dead point, the spring 78 forces the plate 75 to further rotate an angle as determined by the slot and pin connection 79–80, whereupon the plate 75 is stopped at the lowermost position.

Then when the roller 83 approaches the roller 82 from the left or right side and pushes it as shown by solid line, the plate 75 is swung clockwise to the uppermost position. The operation is repeated.

As the operating plate 75 swings in the above-mentioned manner, the switches 72 and 73 are operated. Practically the switches 72 and 73 can be a pair of microswitches arranged at the opposite lateral sides of the operating plate 75 so that swinging of the plate operates the microswitches alternately. The switch 72 has fixed contacts 72*a* and 72*b*, and the switch 73 has fixed contacts 73*a* and 73*b*.

The control circuit further includes a relay 85 having contacts 85*a*, 85*b* and 85*c*, a relay 86 having contacts 86*a*, 86*b* and 86*c*, an electromagnetic switch 87 having contacts 87*a*, and an electromagnetic switch 88 having contacts 88*a*. A series combination of a start switch 89, a relay 90 having contacts 90*a* and 90*b* and the previously mentioned switch 91 (see FIG. 2) is connected between the source terminals. The switch 91 can be a microswitch which is normally closed but pushed open by the dog 92 (FIG. 2) only when the clamper 12 approaching the reference plate 11 from the right side has passed a predetermined position above the reference plate 11. When the clamper 12 approaches from the left, however, the switch 91 is not opened by the dog 92 pushing the switch 91. This type of microswitch is commercially available.

Figure 5:
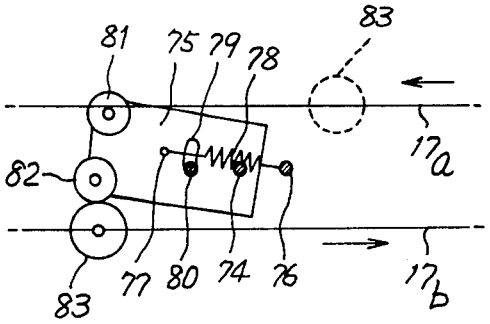
FIG. 5 is a schematic front view of a switch operating device.

Suppose that the clamper 12 is moved initially toward the right, with the operating plate 75 being kept in the position shown in FIG. 5 and the switch 73 being closed at the contact 73*a* as shown in FIG. 6.

The selector switch 71 is first changed over to the other contact 71*a* and then the start switch 89 is closed, whereupon the relay 90 is energized so that the contact 90*a* is closed to keep the switch 89 closed and at the same time the contact 90*b* is closed to connect the circuit to the source. As a result, the relay 86 is energized to close the contact 86*c*, whereupon the electromagnetic switch 88 is operated by alternating current so as to close the contacts 88*a*, so that the motor 19 is energized to rotate. If the direction of rotation of the motor 19 is such that the chain 17 is moved in the direction of the arrows as shown in FIGS. 1 and 5, with the connecting point of the shaft 34 to the chain being on the lower portion 17*b* of the chain 17, the clamper 12 is moved toward the right.

If initially the operating plate 75 is in the lower position to which it has been swung counterclockwise from the position shown in FIG. 5, the connecting point of the shaft 34 to the chain 17 is on the upper portion 17*a* of the chain and the switch 73 is closed at the contact 73*b*. Therefore, the relay 85 is energized to close the contact 85*c* thereby to operate the electromagnetic switch 87, so that the contacts 87*a* are closed to rotate the motor 19 in the opposite direction. Since at this time the direction of rotation of the motor is such that the chain 17 is moved in the direction opposite to that of the arrows shown in FIGS. 1 and 5, the clamper 12 is moved also toward the right.

In short, whichever of the upper and lower positions the operating plate 75 is initially in, the motor 19 is rotated in such a direction as to move the clamper 12 toward the right.

Upon completion of the reciprocating movement, the clamper 12 returns to the original position above the reference plate 11, whereupon the switch 91 is opened to deenergize the relay 90, so that the contact 90*b* is opened to disconnect the circuit from the source of electricity. This restores the relay 85 or 86 and the electromagnetic switch 87 or 88 to the original condition, so that the clamper 12 is stopped. Since the clamper 12 stops after the dog 92 passed the position of the switch 91, the switch 91 is again opened. At this time, the position of the operating plate 75 is reversed, so that the switch 73 is changed over to the contact 73*b*. Under the condition, when the start switch 82 is pressed for the next operation, the motor 19 is rotated in the reverse direction to move the clamper 12 again toward the right. The operation is repeated each time the start switch is pressed.

In the above-described operation, the milling device 15 was not used for bookbinding. The bookbinding operation which includes the milling operation by the milling device 15 will now be explained.

In this case, the selector 71 is changed over to the contact 71*b*. Whether the switch 73 is closed at the contact 73*a* or 73*b* is not known since it depends upon the condition at the end of the preceding operation.

If the connecting point between the shaft 34 and the chain 17 is in the upper portion 17*a* thereof, the switch 73 must have been closed at the contact 73*b* and the running direction of the chain 17 must have been that of the arrows shown in FIGS. 1 and 5 and the switch 72 must have been closed at the contact 72*a* in ganged relation to the switch 73.

Then the start switch 89 is pressed, whereupon the relay 90 is operated to close the contact 90*b* as previously described, so that the relay 86 is operated through the closed contact 72*a* of the switch 72. The motor 19 is then rotated so as to drive the chain 17 in the direction of the arrows, thereby to move the clamper 12 toward the left. After completion of the leftward movement, the clamper 12 is returned to the reference plate 11, from which the clamper 12 is continuously moved toward the right since the switch 91 is not opened at this time. After completion of the rightward movement, the clamper 12 is returned to the reference plate 11, whereupon the switch 91 is opened to stop the clamper 12.

If initially the connecting point between the shaft 34 and the chain 17 is on the lower portion 17*b* of the chain 17, the switches 72 and 73 must have been closed at the contacts 72*b* and 73*a*, respectively, and the running direction of the chain 17 in the preceding operation must have been opposite to the direction of the arrows.

Under the condition, therefore, when the start switch 89 is pressed, the relay 85 is operated through the closed contact 72*b* of the switch 72, whereupon the motor 19 is rotated so as to move the chain 17 in the direction opposite to that of the arrows, so that the clamper 12 is moved toward the left. The succeeding operation is substantially the same as previously mentioned, and the operation is repeated.

The contacts 85*b* and 86*b* are provided so that when one of the relays 85 and 86 is operated, the other is not, and when the operated one is restored, the other is rendered ready for the next operation. The contacts 85*b* and 86*b* are kept opened while the relays 85 and 86 are operated.

As described above in detail, the invention has the advantages that it is not necessary to adjust the operating levels of the adhesive applicator and the cover applicator regardless of whether the milling operation has been conducted or not, and that it is not necessary to place the milling device in or out of the path along which a book to be bound is conveyed.

What I claim is:

1. A bookbinding machine comprising: a clamper for clamping a book comprising a plurality of piled sheets of paper or the like to be bound; means for reciprocating said clamper along a predetermined path consisting of a first portion extending on one side of a reference position and a second portion extending on the opposite side of said reference position; an adhesive applicator disposed on said first portion of said path for applying adhesive to the back of said book; a cover sheet applicator disposed on said first portion of said path for adhering a cover sheet onto said back to which adhesive has been applied by said adhesive applicator; a milling device disposed on said second portion of said path for cutting and roughening the back of said book; means for controlling said reciprocating means so that upon completion of reciprocal movement of said clamper along said second portion of said path, said clamper is reciprocated along said first portion of said path; and means disposed at said reference position for adjusting the level of said back of said book to conform to that of the plane of operation of said adhesive applicator as said clamper carries said book from said second to said first portion of said path.

2. The bookbinding machine of claim 1, including a reference plate disposed at said reference position and having a reference plane for defining the level of the back of said book, to which said operating level of said applicators is set.

3. The bookbinding machine of claim 2, wherein the operating level of said milling device is set in accordance with said reference plane.

4. The bookbinding machine of claim 1, including means for causing said clamper to initially move along one of said first and second positions of said path.

5. The bookbinding machine of claim 1, wherein said adjusting means comprises means for temporarily releasing said book so that the level of said back of said book conforms to that of the operating plane of said applicators.

6. A bookbinding machine comprising: a clamper for clamping a book comprising a plurality of piled sheets of paper or the like to be bound; means for reciprocating said clamper along a predetermined path; a reference plate having a reference plane for defining the level of the back of said book, said reference plate being disposed on said path so that said path consists of a first portion extending on one side of said reference plate and a second portion extending on the opposite side of said reference plate; an adhesive applicator disposed on said first portion of said path so that the operating level of said applicator is able to conform to the level of said reference plane, said applicator being operable to apply adhesive to the back of said book; a cover sheet applicator disposed on said first portion of said path so that the operating level of said applicator is able to conform to the level of said reference plane, said applicator being operable to apply a cover sheet to said back of said book; a milling device disposed on said second portion of said path for cutting and roughening the back of said book, the operating level of said milling device being set in accordance with said reference plane of said reference plate; means for causing said clamper to start from said reference plate to move along one of said first and second portions of said path; means for controlling said reciprocating means so that upon completion of reciprocal movement of said clamper along said second portion of said path, said clamper is reciprocated along said first portion of said path; and means associated with said reference plate for adjusting the level of said back of said book to conform to that of the plane of operation of said adhesive applicator and said cover sheet applicator as said clamper carries said book from said second to said first portion of said path.

* * * * *